US005544666A

United States Patent [19]

Schach

[11] Patent Number: 5,544,666

[45] Date of Patent: Aug. 13, 1996

[54] HAIR STYLING DEVICE

[76] Inventor: Bernadine Schach, 905 Rainbow Dr., Richardson, Tex. 75081

[21] Appl. No.: 521,885

[22] Filed: Aug. 31, 1995

[51] Int. Cl.[6] ..... A45D 8/04; A45D 8/34; A45D 8/36

[52] U.S. Cl. ..... 132/273; 132/275; 132/200; 132/210

[58] Field of Search ..... 132/210, 200, 132/273, 275, 246; D28/39, 40, 41

[56] References Cited

U.S. PATENT DOCUMENTS

| | | | |
|---|---|---|---|
| 53,163 | 3/1866 | Meek . | |
| 416,489 | 12/1889 | Parrish . | |
| 469,191 | 2/1892 | Sooshny . | |
| 1,684,774 | 9/1928 | Montealegre | 132/246 |
| 2,669,239 | 2/1954 | Smith . | |
| 4,369,690 | 1/1983 | Sapkus | 132/210 |
| 4,580,585 | 4/1986 | Sapkus | 132/210 |
| 4,739,776 | 4/1988 | Prijic . | |
| 5,036,870 | 8/1991 | Edmark . | |
| 5,289,834 | 3/1994 | Lawrence . | |
| 5,404,892 | 4/1995 | Bretl . | |

*Primary Examiner*—Gene Mancene
*Assistant Examiner*—Philogene Pedro
*Attorney, Agent, or Firm*—John L. Sigalos

[57] ABSTRACT

A hair styling device comprising a resilient member of elongated material, the device having at its upper extremity a pair of juxtaposed apertures joined by a raised hump. The device includes an additional plurality of apertures formed in a lower serpentine shaped extension. Locks of hair are extended through the apertures and held in place while the user is braiding them. Thus, multiple locks can conveniently be braided by the user with two hands only, thus obviating the necessity for assistance from a third party. The invention also includes a method of braiding hair utilizing the foregoing device.

14 Claims, 4 Drawing Sheets

HAIR STYLING DEVICE

Invention relates to hair styling accessories and more particularly to such accessories adapted for shaping long hair into braids while minimizing or eliminating the requirement for pins, clamping devices or assistance from others.

BACKGROUND OF THE INVENTION

As is known to those skilled in the art, the styling of women's hair has found expression in many and varied forms. One of the oldest and most fundamental involves the utilization of braiding to form long and diffuse hair into a compact elongated form. However, braids typically involve at least three principal strands, and since braids generally are formed to align with the center of the back of the head, braiding hair by the person herself has been difficult without assistance from another party. Moreover, it is desirable in many instances to divide the hair into more than three principal strands so as to present a more pleasing appearance, thus complicating the braiding procedure.

It has been found that the use of certain devices has substantially simplified the styling of hair. Thus, for example, in U.S. Pat. No. 5,303,723 granted to Denie Schach on Apr. 19, 1995, there is disclosed an auxiliary styling device which simplifies the styling of hair into desired shapes such as buns, ponytails, French knots, braids, cascades and other shapes. Another prior proposal is that set forth in U.S. Pat. No. 4,369,690 granted to Jurgis Sapkus Jan. 25, 1983. However, the proposals of that patent appear to be limited to three principal strands of hair and require the use of moving parts actuated by a pivotal trigger, thus being complex. Even practical and effective, however, as such known auxiliary styling devices may have been, there has continued to be a need for a simple passive device to facilitate the braiding of three or more strands of one's own long hair.

BRIEF SUMMARY OF THE INVENTION

The improved hair styling auxiliary device according to the invention comprises an elongated shaped member substantially as shown in FIG. 1 of the drawing. It includes a generally S-shaped lower portion adapted for positioning and holding a central lock of hair in successive over and under loops. At the upper extremity of the member there is a section having a central raised portion at both sides of which there are inwardly curving members to form specially shaped apertures through which locks of hair are passed when the device is in use. The method employing the device includes steps of alternately positioning locks of hair from the sides of the head as described below.

OBJECTS AND FEATURES OF THE INVENTION

It is one general object of the invention to improve hair styling accessories.

It is another object of the invention to facilitate braiding of long hair by the owner.

It is still another object of the invention to facilitate use of a hair braiding device without the requirement for pins or other accessory clamping devices.

It is yet another object of the invention to provide for braiding of more than three strands of hair.

Accordingly, in accordance with one feature of the invention, there is provided an elongated resilient member that is formed into a serpentine shape thereby to produce a plurality of partial loops through which hair braids are passed and held while braiding is conducted.

In accordance with another feature of the invention, openings are provided to facilitate separately passing strands or locks of hair through the aforementioned partial loops thereby simplifying the positioning of strands or locks while conducting the desired braiding of the hair.

In accordance with still another feature of the invention, provision is made for successively including additional locks of hair beyond those employed in making the initial loops, thereby providing for more than three locks in a completed braid.

These and other objects and features of the invention will be apparent from the following description, by way of example of a preferred embodiment, with reference to the drawing.

DESCRIPTION OF A PREFERRED EMBODIMENT

Figure 1:
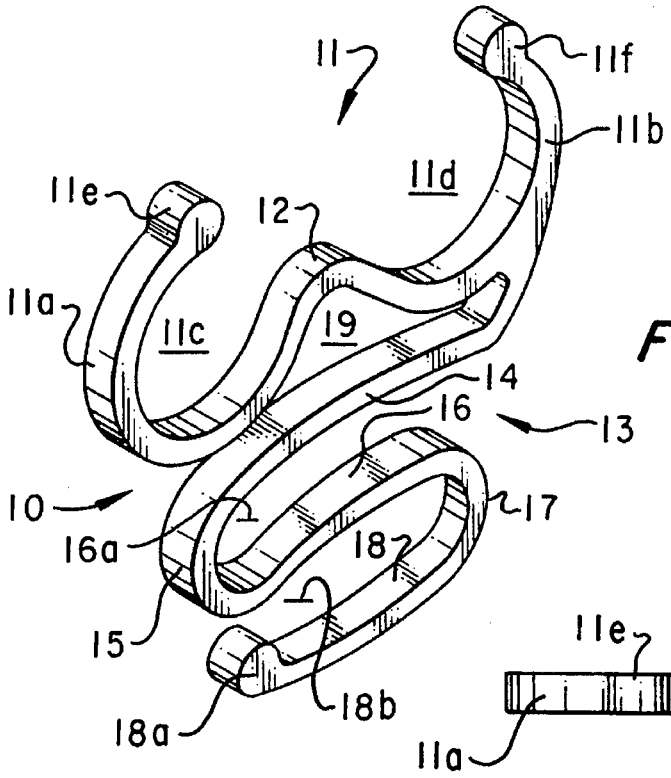
FIG. 1 is a perspective view depicting a hair braiding accessory device according to the preferred embodiment.

Now turning to the drawing, and more particularly FIG. 1 there, it will be seen that there is therein depicted a resilient ribbon-like member most suitably made of molded plastic (generally shown at 10) having: (1) a top part 11 with a central generally triangularly shaped hump 12; and (2) a lower part 13 having an S shape defined by serpentine parts 14–8. These provide a plurality of apertures and loops through which strands or locks are passed during braiding as will be evident from the following description. Serpentine part 18 terminates in a slightly enlarged end **18*a* which is provided partly for esthetics but more importantly to assist in retaining hair within aperture 18*b***.

Top part 11 is seen to include, in addition to central hump portion 12, left hand curved section 11*a* and right hand curved section 11*b* which respectively form left hand semicircular aperture 11*c* and right hand semicircular aperture 11*d*. At the outer extremities of sections 11*a* and 11*b* there are slightly enlarged curved ends 11*e* and 11*f* which add a decorative appearance and aid in retaining locks of hair in place when positioned within apertures 11*c* and 11*d*.

It should be noted that hump 12 not only contributes to the identity of juxtaposed apertures 11*c* and 11*d* but it also establishes another partially triangular aperture 19 which is located between the lower surface of generally triangularly shaped hump 12 and the upper surface of serpentine part 14. As will be seen later, aperture 19 facilitates temporary retention of certain locks of hair positioned therewithin during the braiding procedure.

Figure 2:
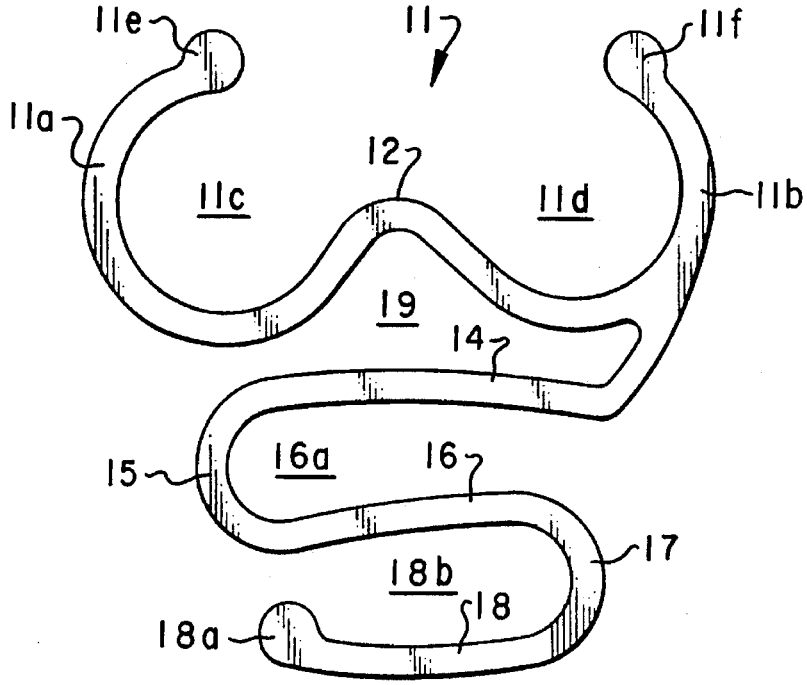
FIG. 2 is a front elevation view of the device of FIG. 1

Now turning to FIG. 2, it will be seen to be a front elevation view of the device of FIG. 1 and its parts are similarly identified. There the apertures 11*c*, 11*d*, 19, 16*a* and 18*b* are more clearly depicted. As will be evident from the following description, these apertures are important in providing for the desired placing and interleaving of strands of hair as braiding progresses.

Figure 3:
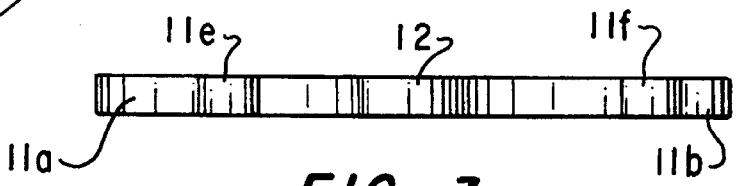
FIG. 3 is a top view of the device of FIG. 2.

FIG. 3 is a top view of the device of FIG. 2 and shows ends 11*e* and 11*f* together with sides 11*a*/11*b* and hump region 12.

Figure 4:
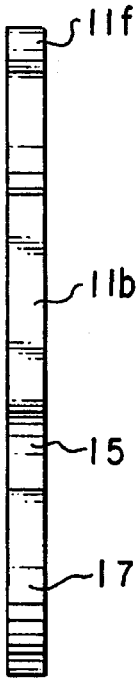
FIG. 4 is a right side elevation view of the device of FIG. 2.

FIG. 4 is a side elevation of the device of FIG. 2 and shows upper right end 11*f*, upper right side 11*b*, serpentine part 15, and serpentine part 17.

Figure 5:
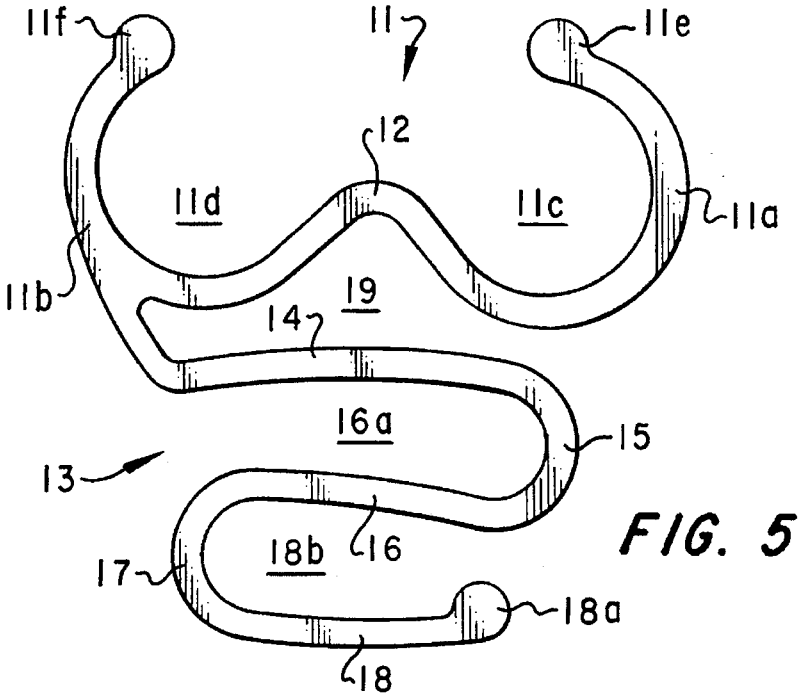
FIG. 5 is a rear elevation view of the device of FIG. 2.

FIG. 5 is a rear elevation of the device according to the preferred embodiment of the invention and depicts the parts previously described in connection with FIGS. 1–4.

Figure 6:
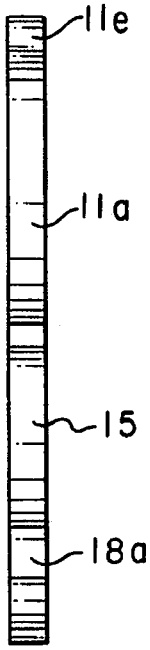
FIG. 6 is a left side elevation view of the device of FIG. 2.
Figure 7:
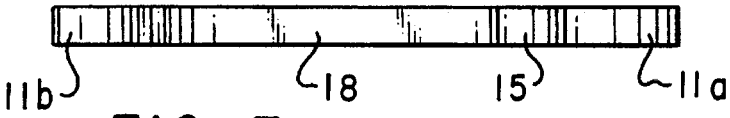
FIG. 7 is a bottom view of the device of FIG. 5.

FIG. 6 is a side elevation, and FIG. 7 is a bottom view of the device as depicted in FIG. 6.

Figure 8:
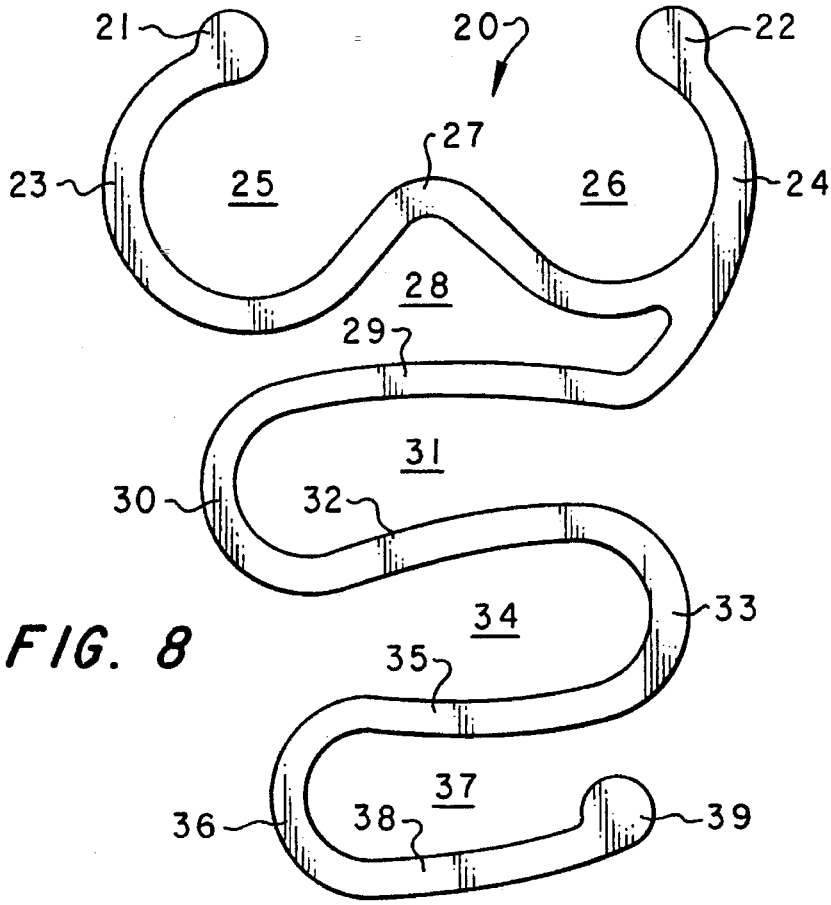
FIG. 8 is a front elevation view of an alternative device having an additional loop at its lower extremity.

FIG. 8 illustrates an alternate embodiment in which an additional loop 36/38 is added at the bottom to form an additional aperture which is identified as aperture 37. Otherwise, elements in the preferred embodiment of FIGS. 1–7 correspond as follows: 21 to 11*e*; 22 to 11*f*; 23 to 11*a*; 24 to 11*b*; 25 to 11*c*; 26 to 11*d*; 27 to 12; 28 to 19; 29 to 14; 30 to 15; 31 to 16*a*; 32 to 16; 33 to 17; 34 to 18*b*; 35 to 18; and 39 to 18*a*.

The additional loop 36/38 provided in the device of FIG. 8 finds usefulness for very long hair giving additional control.

As mentioned above, a method of styling hair utilizing the foregoing hair braiding device is illustrated by FIGS. 9–15. In the method shown, the embodiment of FIG. 8 is utilized. However, it should be understood that all of the steps excepting the passing of the central lock of hair under part 38 is equally applicable to utilization of the device of FIGS. 1–7.

Figure 9:
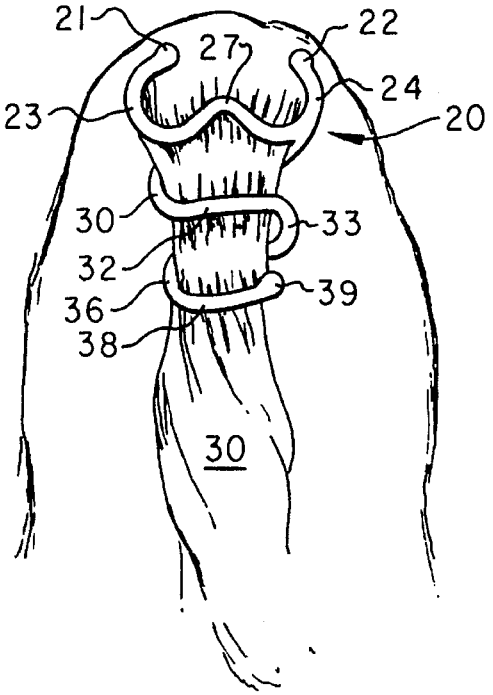
FIG. 9 is a view illustrating an initial step in a method of braiding hair using the device of FIGS. 1–8.

FIG. 9 illustrates an initial step which involves preparing an elongated lock of hair 30 and interleaving it between members of the device 20. Thus, lock 30 is passed beneath hump part 27 and the adjacent lower portions of parts 23 and 24, outwardly through aperture 28, over part 29 and downwardly through aperture 31 and under part 32, outwardly through aperture 34 and over part 35 and (for the device of FIG. 8) downwardly through aperture 37 and under part 38.

Figure 10:
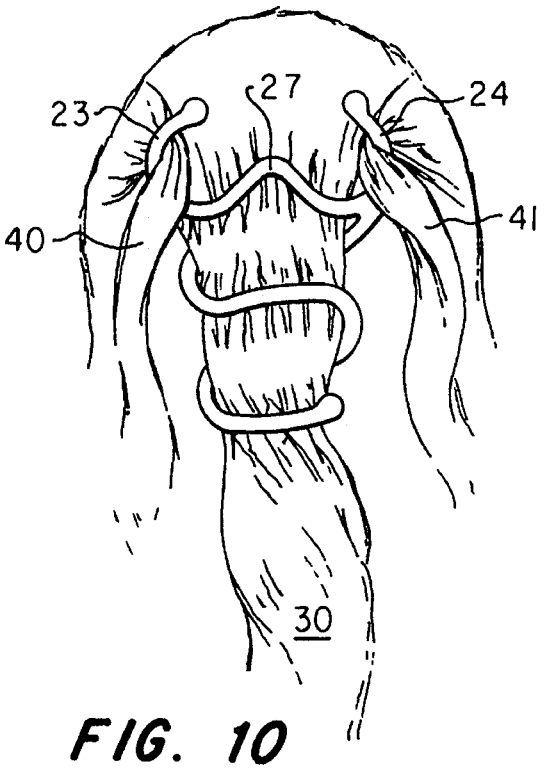
FIG. 10 is a view illustrating a next step in a method of braiding hair using the device.

Next, in FIG. 10, preparing and positioning of two additional locks or strands of hair 40 and 41 are shown. They preferably are taken from opposite sides of the head of the user and preferably (although not necessarily) are immediately adjacent to the initial lock or strand of hair 30. Strand 40 is moved to the position shown where it is within but at the left hand edge of aperture 25 (FIG. 8); and strand 41 is moved to the position shown where it is within but at the right hand edge of aperture 26 (also FIG. 8).

Figure 11:
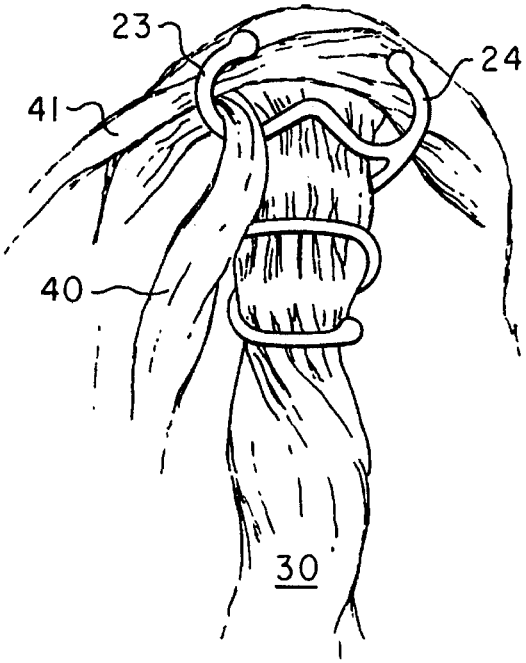
FIG. 11 is a view illustrating a third step in a method of braiding hair using the device.
Figure 12:
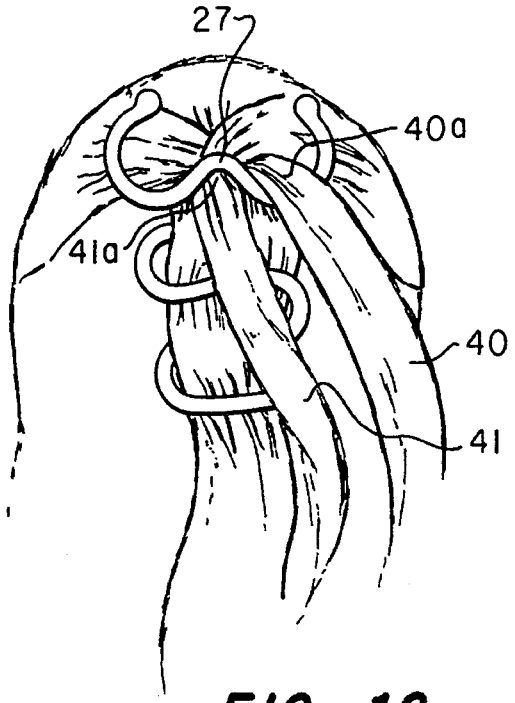
FIG. 12 is a view illustrating a fourth step in a method of braiding hair using the device.

The next step is shown in FIG. 11 where it is seen that lock 41 has been moved so that it is behind both part 23 and 24 and so that it overlies lock 40 as shown. It is then partially urged to the right and in so doing moves lock 40 (which is in contact with it) so that portion 40*a* of lock 40 extends beneath portion 41*a* of lock 41 and thence through aperture 26 (FIG. 8). At the same time, portion 41*a* of lock 41 is extended beneath hump 27 and through partially triangular aperture 28. When this has been accomplished, the method of use moves to FIG. 13 which illustrates the preparation and positioning of a fourth strand of hair 42. As is shown in the drawing, strand 42 preferably is prepared with hair growing just below and immediately adjacent to lock 40. However, such is not necessary to a successful practice of the method hereof.

Figure 13:
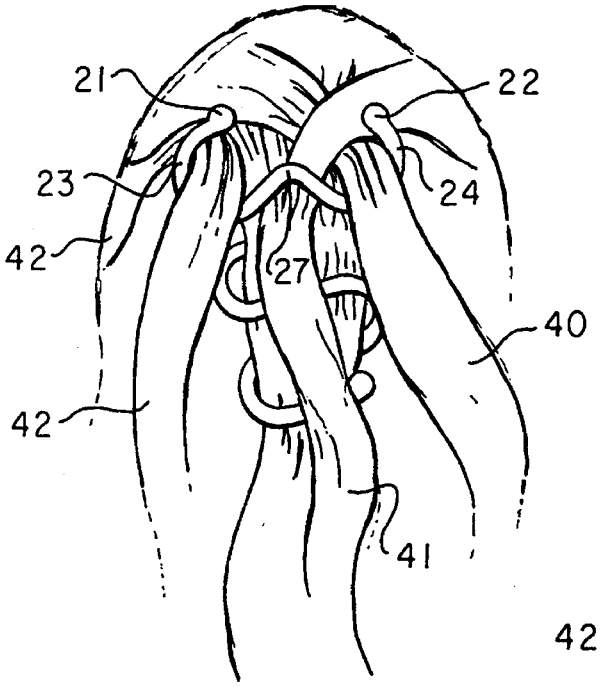
FIG. 13 is a view illustrating a fifth step in a method of braiding hair using the device.
Figure 14:
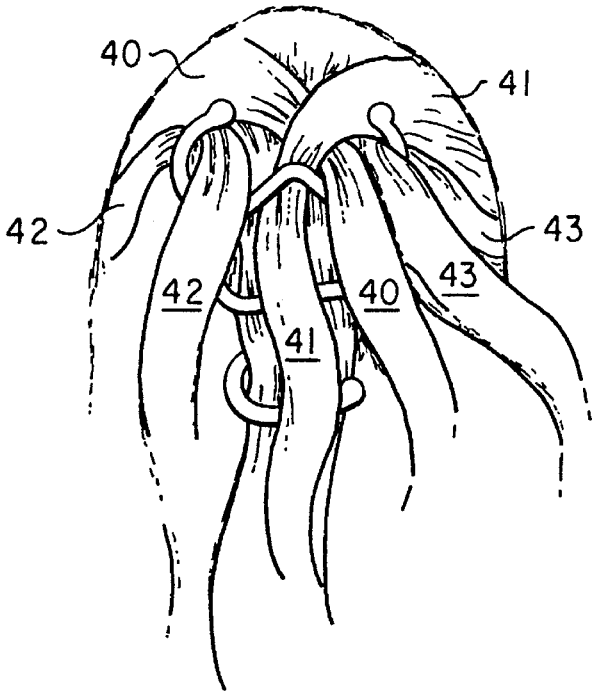
FIG. 14 is a view illustrating a sixth step in a method of braiding hair using the device.
Figure 15:
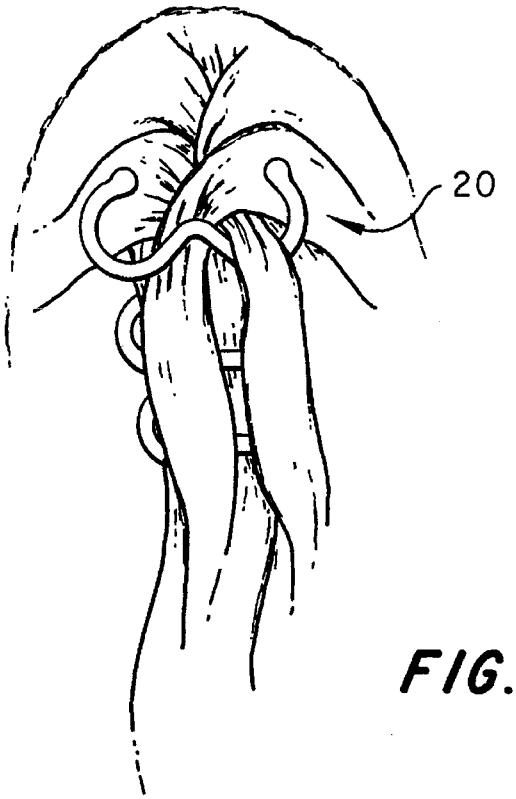
FIG. 15 is a view illustrating a seventh step in a method of braiding hair using the device.

As is shown in FIG. 13, fourth strand 42 is looped through aperture 25 on its left side and adjacent part 23 of device 20; and as shown in FIG. 14, a fifth strand 43 is prepared and looped through aperture 26 adjacent its right side 24 (FIG. 8). FIG. 15 illustrates a finished soft, or French, braid. At this point a hair holder, such as a clip, elastic, or the like, as is conventional, can be placed in the hair to hold the braid in place and device 20 removed. Alternatively, the sequence of steps set forth in FIGS. 9 to 14 can be repeated as often as necessary to continue the braiding to the length desired and device 20 then removed.

It will be evident that in addition to French braids, device 20 can be used to form conventional braids by proper movement of hair strands as is well known to those who braid.

The instant invention permits the manipulation of three or more strands of hair by a person deciding to braid their own hair or making it possible for someone assisting to easily handle and manipulate a plurality of strands.

The placement of device 20 in the hair and sequence of steps described to form the braid are for a right-handed person. A left-handed person need only place device 20 in the hair so that part 24 is on the left side of the head, and make the corresponding adjustments as to movement of strands of hair to form the braid.

It will now be evident that there has been described herein an improved hair styling accessory and method of use which are adapted for conducting unassisted self braiding of one's hair.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. An improved hair braiding device comprising an elongated structure having an upper section and a lower section; said upper section having:

(a) a right side and a left side, said right side being bounded by a surface defining a first aperture, said left side being bounded by another surface defining a second aperture, said first and said second apertures being disposed in juxtaposed relation; and (b) a hump within said elongated structure joining said right side and said left side;

said lower section being connected with said upper section and having a plurality of serpentine bends defining with said upper section a third aperture between said hump and one of said bends.

2. An improved hair styling device according to claim 1 wherein said elongated structure is resilient.

3. An improved hair styling device according to claim 1 wherein said elongated structure is monolithic.

4. An improved hair styling device according to claim 1 wherein said first and said second apertures define generally semi-circular openings.

5. An improved hair styling device according to claim 1 wherein said hump is generally triangular in shape.

6. An improved hair styling device according to claim 1 wherein said first and said second apertures are essentially co-planar.

7. An improved hair styling device according to claim 1 wherein said elongated structure is generally rectangular in cross-section.

8. An improved hair styling device according to claim 1 wherein said plurality of serpentine bends comprises two bends.

9. An improved hair styling device according to claim 1 wherein said plurality of serpentine bends comprises three bends.

10. A method of styling a person's hair comprising steps of:

(a) disposing a styling accessory device adjacent a rear part of one's head, said styling accessory having an upper section with a pair of juxtaposed apertures joined by a hump section defining an upper boundary of a third aperture, and a lower section with a plurality of serpentine bends forming a plurality of generally horizontal parallel parts;

(b) forming a first strand of hair from a top the head of said person;

(c) intertwining said first strand successively over and under successive ones of said plurality of generally horizontal parallel parts thereby retaining said accessory device in position adjacent said rear part of said one's head;

(d) forming a second strand of hair from hair growing adjacent and alongside said first strand of hair;

(e) forming a third strand of hair from hair growing adjacent and alongside said first strand of hair at a position on an opposite side of said first strand from said second strand;

(f) passing said second strand through a first of said juxtaposed apertures and passing said third strand through a second of said juxtaposed apertures;

(g) moving said second strand from said first of said apertures and passing said second strand over said third strand and through said third aperture underlying said hump section;

(h) forming a fourth strand of hair from hair growing adjacent and alongside said second strand;

(i) forming a fifth strand of hair from hair growing adjacent and alongside said third strand;

(j) passing said fourth strand through said first of said juxtaposed apertures; and (k) passing said fifth strand through said second of said juxtaposed apertures.

11. The method of styling a person's hair according to claim 10 in which said step of moving said second strand from said first of said apertures and passing said second strand over said third strand and through said third aperture underlying said hump section includes moving said third strand from said second of said apertures to said first of said apertures.

12. The method of styling a person's hair according to claim 10 in which said step of passing said fourth strand through said first of said juxtaposed apertures includes moving said fourth strand underneath a part of said second strand.

13. The method of styling a person's hair according to claim 11 in which said step of passing said fourth strand through said first of said juxtaposed apertures includes moving said fourth strand underneath a part of said second strand.

14. The method of styling a person's hair according to claim 10 further including a step of locking said strands into place upon said styling accessory device.

* * * * *